US012318657B1

(12) United States Patent
Nolan et al.

(10) Patent No.: US 12,318,657 B1
(45) **Date of Patent: *Jun. 3, 2025**

(54) EXERCISE MACHINE SYSTEM AND METHOD OF USE

(71) Applicant: Bulletproof Fitness Equipment Inc, Acton, CA (US)

(72) Inventors: Nicole Nolan, Santa Clarita, CA (US); Lawerence R. Nolan, Santa Clarita, CA (US)

( * ) Notice: Subject to any disclaimer, the term of this patent is extended or adjusted under 35 U.S.C. 154(b) by 225 days.

This patent is subject to a terminal disclaimer.

(21) Appl. No.: 17/677,278

(22) Filed: Feb. 22, 2022

Related U.S. Application Data

(63) Continuation-in-part of application No. 17/034,950, filed on Sep. 28, 2020, now Pat. No. 11,517,785.

(51) Int. Cl.
*A63B 21/00* (2006.01)
*A63B 21/062* (2006.01)

(52) U.S. Cl.
CPC ..... *A63B 21/4047* (2015.10); *A63B 21/0626* (2015.10); *A63B 21/4035* (2015.10); *A63B 21/151* (2013.01); *A63B 2225/093* (2013.01)

(58) Field of Classification Search
CPC ..... A63B 21/156; A63B 21/4035; A63B 21/4047; A63B 21/00058; A63B 21/00061; A63B 21/00065
See application file for complete search history.

(56) References Cited

U.S. PATENT DOCUMENTS

| | | | | |
|---|---|---|---|---|
| 5,788,614 | A | 8/1998 | Simonson | |
| 6,238,323 | B1 | 5/2001 | Simonson | |
| 6,302,833 | B1 | 10/2001 | Ellis et al. | |
| 6,488,612 | B2 | 12/2002 | Sechrest et al. | |
| 6,685,601 | B1 | 2/2004 | Knapp | |
| 6,905,446 | B2 | 6/2005 | Greenland | |
| 7,455,621 | B1 | 11/2008 | Anthony | |
| 7,918,771 | B2 * | 4/2011 | Rogers | A63B 21/4035 482/100 |
| 9,950,206 | B2 | 4/2018 | Biddix, Jr. | |
| 11,013,945 | B2 | 5/2021 | Sorin et al. | |
| 11,173,337 | B2 * | 11/2021 | Jones | A63B 21/0615 |

(Continued)

FOREIGN PATENT DOCUMENTS

| | | | |
|---|---|---|---|
| WO | 2019199352 | A1 | 10/2019 |
| WO | 2023163728 | A1 | 8/2023 |

OTHER PUBLICATIONS

International Search Report, dated Jul. 12, 2022, issued in International Patent Application PCT/2022/023315, 1 page.

*Primary Examiner* — Megan Anderson
(74) *Attorney, Agent, or Firm* — Avek IP, LLC

(57) ABSTRACT

An exercise machine system includes a first vertical post; a first lever arm coupled to the first vertical post via a first carriage, the first lever arm is to be operated by a user; and the first carriage forming a channel to receive the first vertical post therein, the first carriage having a pivoting system allowing for the first lever arm to: (1) rotate around a vertical axis to adjust between a first position around the vertical axis and a second position around the vertical axis; (2) rotate around a horizontal axis to adjust between a first position around the horizontal axis and a second position around the horizontal axis; and (3) pivot about a vertical plane, the vertical plane is offset from and parallel to the vertical axis.

15 Claims, 23 Drawing Sheets

(56) References Cited

U.S. PATENT DOCUMENTS

| | | | | |
|---|---|---|---|---|
| 2007/0203002 | A1 | 8/2007 | Webber | |
| 2010/0152001 | A1 | 6/2010 | Gordon | |
| 2013/0184128 | A1 | 7/2013 | Towley, III et al. | |
| 2017/0056707 | A1 | 3/2017 | Hockridge et al. | |
| 2019/0269963 | A1* | 9/2019 | Steenekamp ..... | A63B 23/1254 |

* cited by examiner

EXERCISE MACHINE SYSTEM AND METHOD OF USE

CROSS REFERENCE TO RELATED APPLICATIONS

This application is a continuation-in-part of, and claims priority to, U.S. patent application Ser. No. 17/034,950 filed Sep. 28, 2020, of which is hereby incorporated by reference in its entirety.

BACKGROUND

1. Field of the Invention

The present invention relates generally to exercise machines, and more specifically to an exercise machine system that allows for incorporation of a plurality of attachments and a plurality of configurations, thereby allowing for the user to utilize one machine for a multitude of exercises.

2. Description of Related Art

Exercise machines are well known in the art and are effective means to provide various functions for the user to engage in one or more exercises. For example, FIG. 1 depicts a conventional exercise system 101 having a frame 103 configured to support an arm 105 with a handle 109, the arm 105 being pivotally connected 107 to the frame. During use, the user may add weight and/or resistance while utilizing arm 105.

One of the problems commonly associated with system 101 is limited use. For example, the user can only perform a limited number of exercises with the system. The user will then move on to another apparatus or machine to complete additional exercises.

Accordingly, although great strides have been made in the area of exercise machine systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
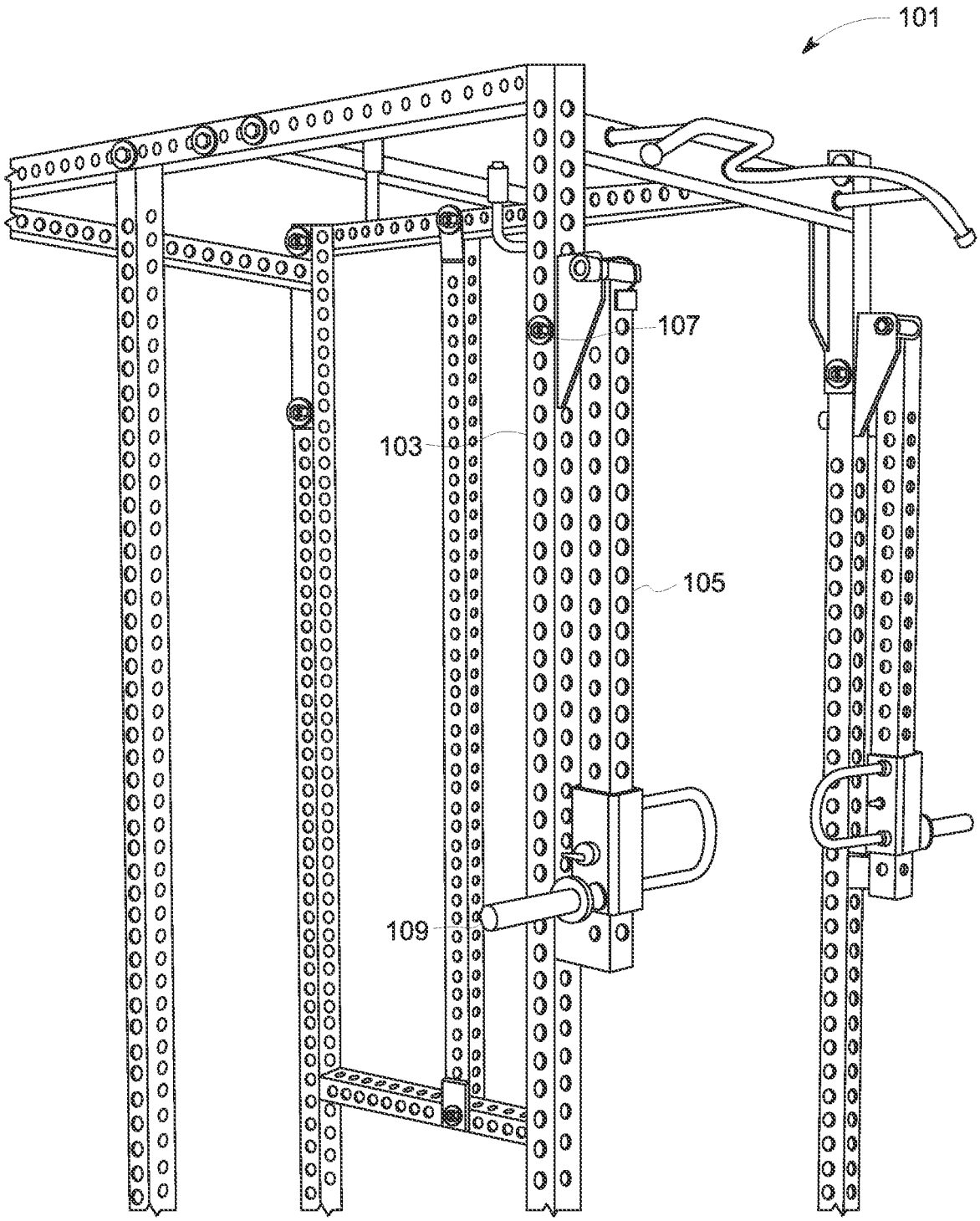
FIG. 1 (PRIOR ART)
FIG. 1 is an isometric view of a common exercise machine system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional exercise machine systems. Specifically, the present invention provides for an exercise machine system that utilizes a carriage that provides for multi-directional movement of an arm, as well as a plurality of attachment systems to allow for various device attachments, these features allowing a user to manipulate the machine as needed for a multitude of exercises. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
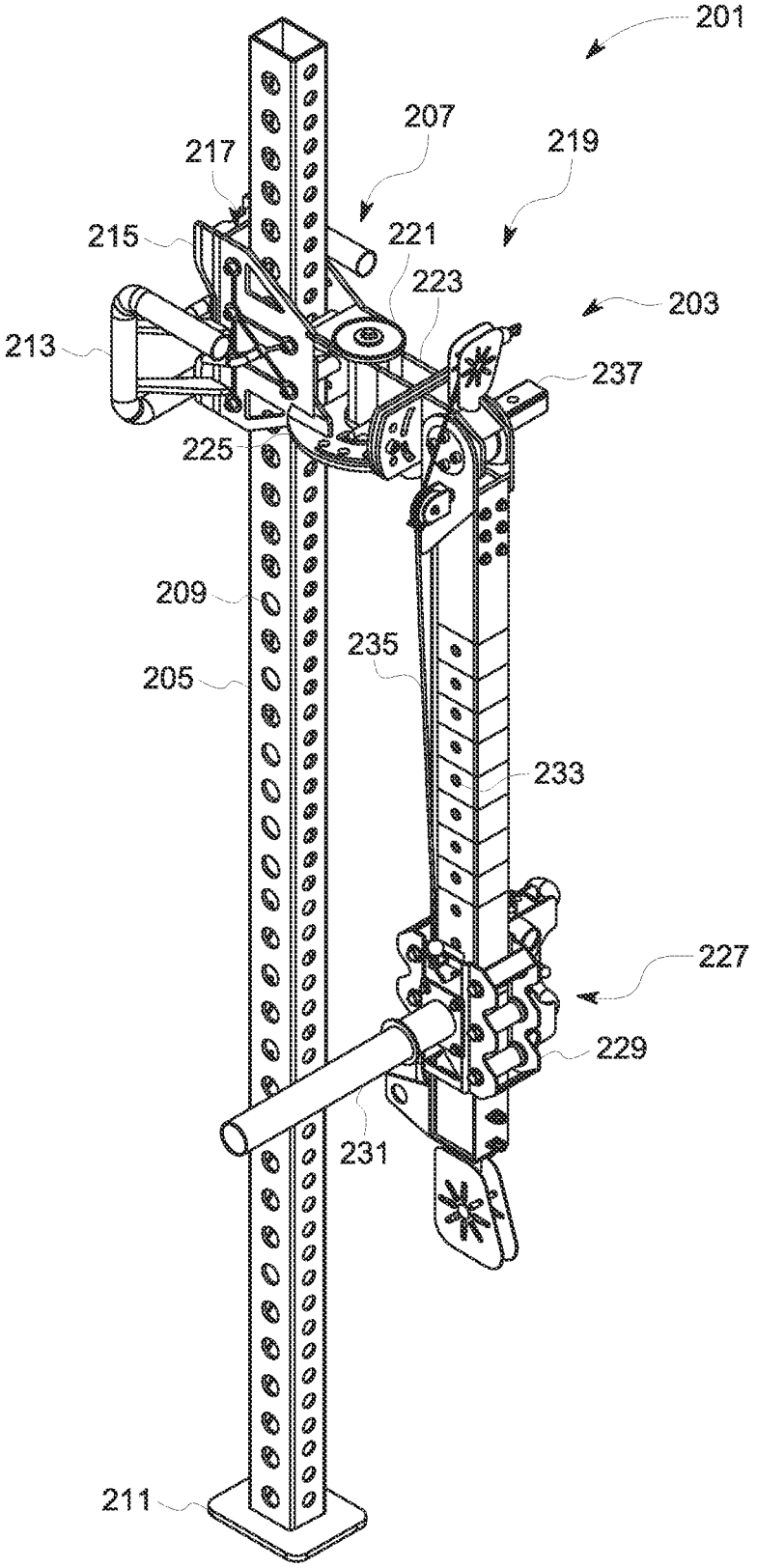
FIG. 2 is a front perspective view of an exercise machine system in accordance with one or more embodiments of the present invention.

Referring now to the drawings wherein like reference characters identify corresponding or similar elements throughout the several views, FIG. 2 depicts a front perspective view of an exercise machine system 201 in accordance with a preferred embodiment of the present application. It will be appreciated that system 201 overcomes one or more of the above-listed problems commonly associated with conventional exercise systems. It should also be appreciated that system 201 may vary as functional, manufacturing, or aesthetical considerations require.

In the contemplated embodiment, the exercise machine system 201 includes a plurality of lever arms 203 coupled to a plurality of vertical posts 205 via a carriage 207. It should be appreciated that the vertical posts 205 may be, at least in part, from a Smith machine, a functional training rig, or the like. In addition, the vertical posts 205 may include a plurality of adjustment holes 209 for receiving different accessories or attachments (e.g., the carriage 207). Further, the vertical posts 205 may include foot plates 211 at lower ends thereof for anchoring the vertical posts 205 to the floor.

The carriage 207 is configured to adjust up and down along the vertical posts 205 via the plurality of adjustment holes 209. The carriage 207 includes one or more handles 213 for user manipulation. The carriage 207 also includes a first brace 215 creating a channel 217 to engage with the one or more vertical posts 205. The carriage 207 also includes a pivoting system 219 extending from the first brace 215. The pivoting system 219 includes a side-to-side pivoting connection 221 attached to a second brace 223. The side-to-side pivoting connection 221 allows for the second brace 223 to pivot about a horizontal axis, thereby allowing for horizontal movement of the lever arm 203. The pivoting system 219 also includes a rotating connection 225 attached to the second brace 223. The rotating connection 225 allows for the lever arm 203 to pivot from side-to-side.

The exercise machine system 201 also includes a grip system 227 coupled to the lever arm 203 via an attachment device 229. The attachment device 229 includes a handle 231 for user manipulation. The lever arm 203 also includes a plurality of adjustment holes 233 for additional adjustability of the grip system 227.

The exercise machine system 201 further includes a cable system 235 which provides for attachment and manipulation of various devices that can be used for various exercises. In addition, one or more protrusions 237 extend from the lever arm 203 for such engagement as well.

It should be appreciated that one of the unique features believed characteristic of the present application is the carriage 207, which provides for various manipulation of the lever arms 203, thereby providing for various exercise configurations and uses. For example, the carriage 207 allows for the lever arms 203 to be adjusted vertically, from side-to-side, and in a pivoting direction.

It should also be appreciated that because of the various adjustments that can be performed via the carriage 207, the exercise machine system 201 is suitable for adding attachment devices that can provide a number of exercises. The use of the attachments can go on to perform all hammer strength or cybex leverage type movements such as decline chest press, chest press, incline chest press, military press, all variations of lat pulling and rowing movements, dips, and more. A leg press foot plate attachment allows for the lever arms to dock into the versa-form to become a 45-degree leg press unlike anyone has ever been able to do. The foot plate attachment also can swivel to allow arms to become a vertical leg press or be paired with the leverage arm and then do all leverage leg press moves as well taking place of all of those machines. The shoulder full back pad attachment allows arms to become a pendulum squat machine by using the versa forms angles foot plate. That same attachment used in other ways can allow arms to become a hack squat, hip sled, V squat. A shoulder pad attachment allows arms to become a squat pro machine. A tri axis single handle attachment can be used to perform many of the above-mentioned moves and more by allowing ultimate adjustability for the handle to confirm to almost any lever, leverage, or smith machine movement. The counterbalance cable attachment allows the leverage arm and its carriage to attach to the lever arms cable and then become a counterbalance to perform all counter balance exercises like assisted pull-ups or dips. Cushion pads attachment can be used to make arms into leg extension, leg curl, low back extension, seated Ab machine and more. Curved bar attachment can make arms into a preacher curl, overhead tricep extension, and more. A Smith straight bar allows arms to use carriage system to be used as a smith machine Single handles can be used to perform unilateral smith type functions as well as unilateral lever and leverage moves. This design can also be modified to use stack weight and cable it allows the same movements and machine functions but no plate weights needed.

During operation of the exercise machine system 201, the user would add on a desired attachment and perform a desired exercise. As needed, the user can switch out attachments and continue with their workout.

Figure 3:
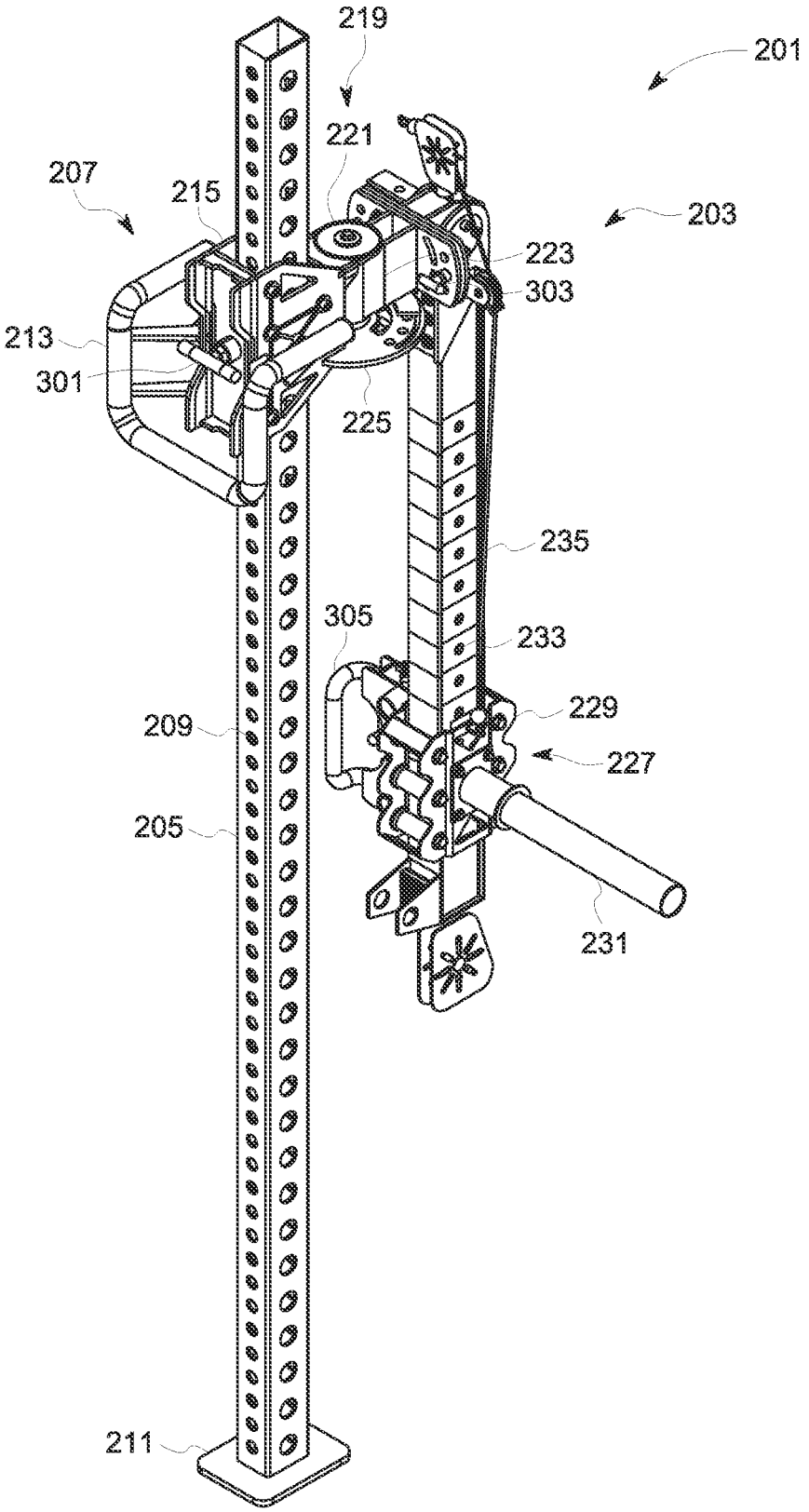
FIG. 3 is a rear perspective view of the exercise machine system of FIG. 2.

In FIG. 3, a rear perspective view of the exercise machine system 201 is shown for clarity. As shown, the carriage 207 includes a locking pin 301 to removably secure the carriage to the vertical post 205 at a desired location. The carriage 207 also includes a set of locking pins 303 to removably secure the lever arm 203 to the second brace 223. Further shown in this figure is a second handle 305 that is part of the grip system 227 to provide for easy user manipulation.

Figure 4:
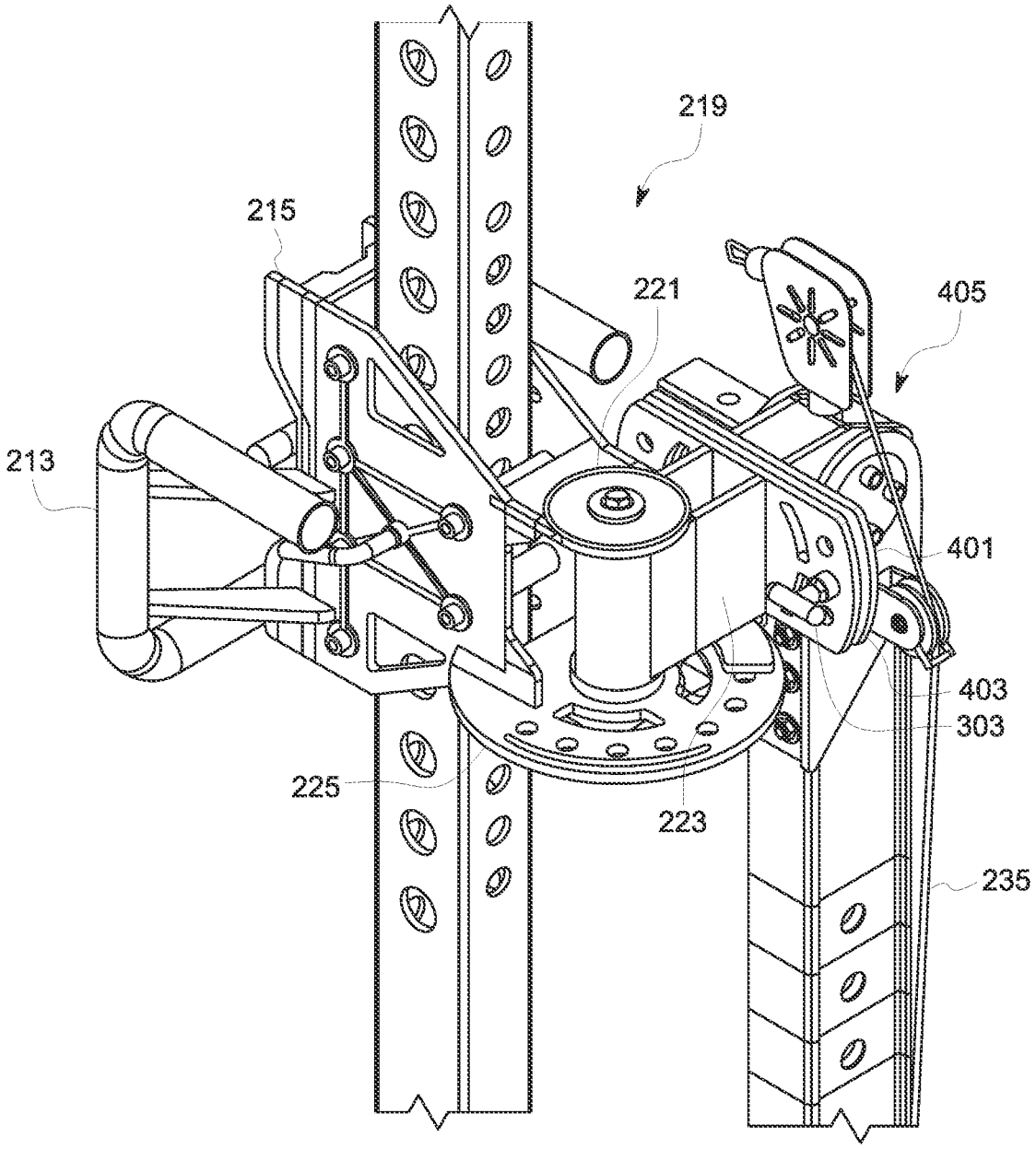
FIG. 4 is a close-up view of a carriage of the exercise machine system of FIG. 2.
Figure 5:
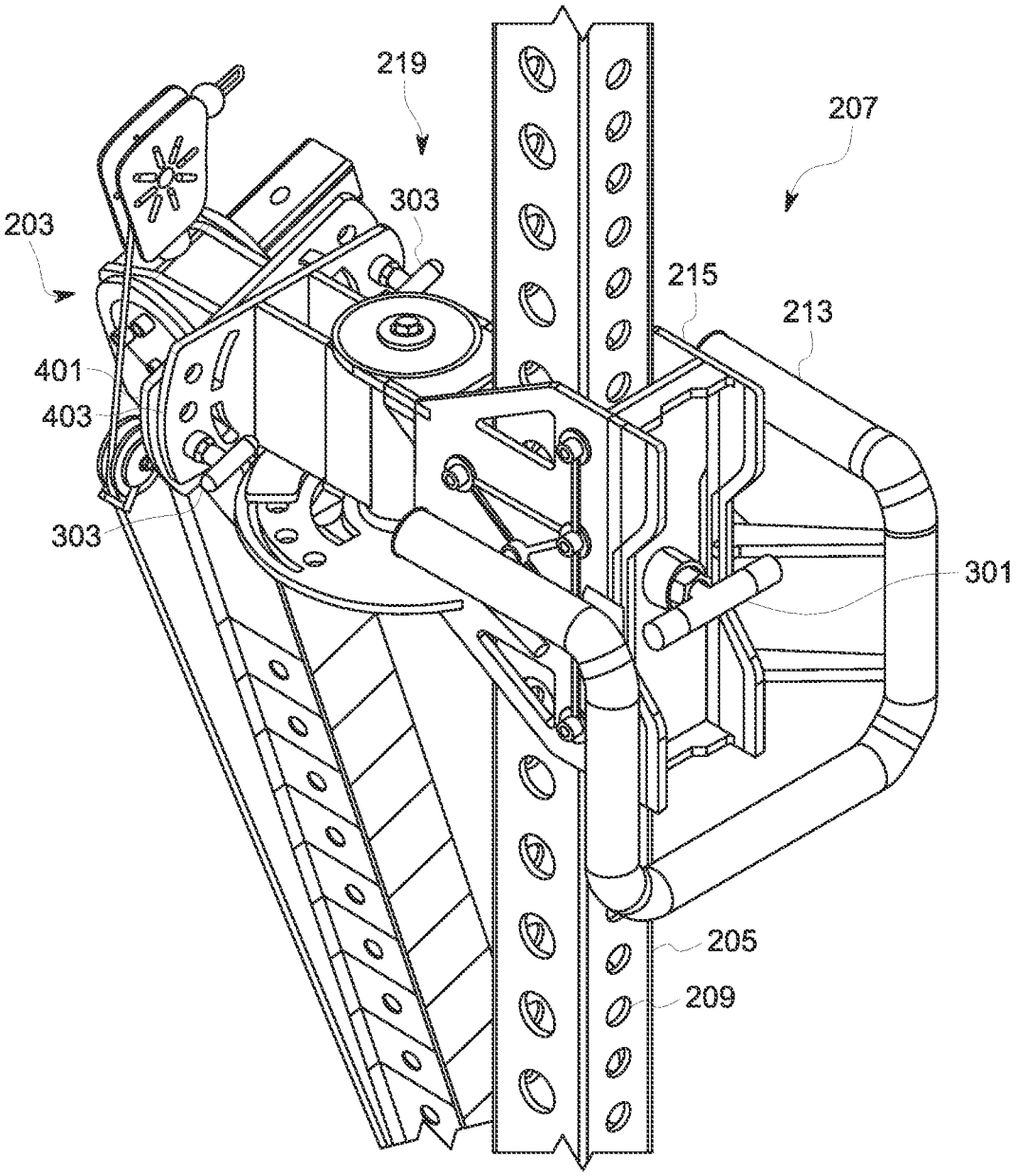
FIG. 5 is a second close-up view of the carriage of the exercise machine system of FIG. 2.

In FIGS. 4 and 5, closer views of the carriage 207 are shown. As shown, the lever arm 203 is in a shifted position via the side-to-side pivoting connection 221. As shown, the rotating connection 225 allows for movement about the horizontal axis to a desired location. As further shown, the rotating connection 225 includes a first plate 401 and second plate 403 that pivot relative to one another and secure in place via the set of locking pins 303, this rotational movement being depicted in FIG. 5. As further shown, the cable system 229 may include a top cable support 405.

Figure 6:
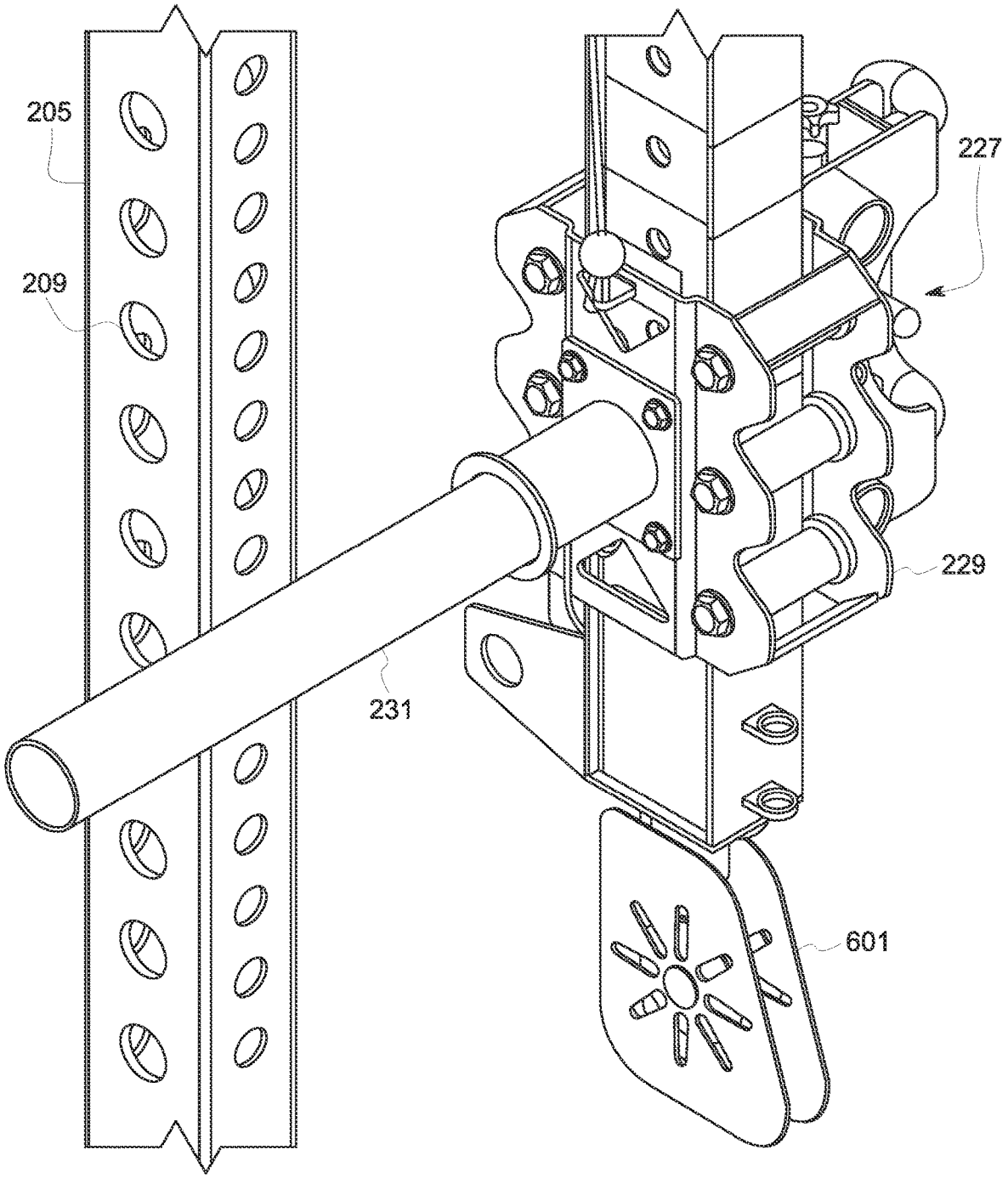
FIG. 6 is a close-up view of a grip support of the system of FIG. 2.

In FIG. 6, a closer view of the grip system 227 is shown. As shown, the grip system may also include a cable attachment point 601 which allows for attachment of various cables that can be used for various exercises.

Figure 7:
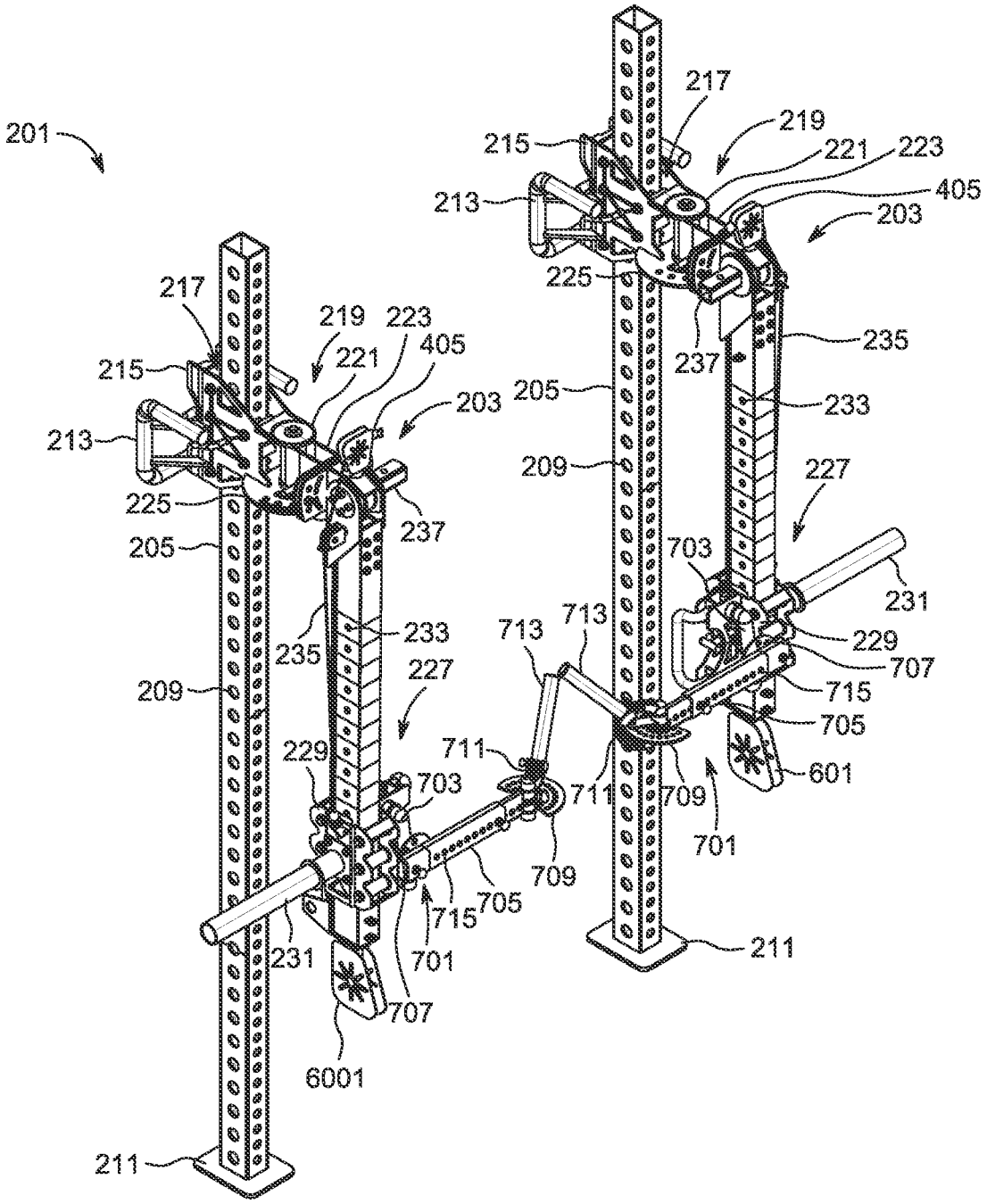
FIG. 7 is a front perspective view of the exercise machine system of FIG. 2, illustrating a pair of tri axis attachments coupled to the lever arms.

In FIG. 7, front perspective view of the exercise machine system 201, illustrating a pair of tri axis attachments 701 coupled to the lever arms 203 via an attachment device 703. As shown, the tri axis attachments 701 include a horizontal bar 705 extending from the attachment device 703 and a first rotating connection 707. The first rotating connection 707 allows the horizontal bar 705 to pivot up and down along a vertical axis.

The tri axis attachments 701 also include a second rotating connection 709 and a third rotating connection 711 coupled to a free end of the horizontal bar 705. The second rotating connection 709 allows for a handle 713 to pivot from side-to-side. The third rotating connection 711 allows for the handle 713 to pivot up and down along a vertical axis. Additionally, the horizontal bar 705 includes a plurality of attachment holes 715 to provide additional adjustability of the tri axis attachments 701.

Figure 8:
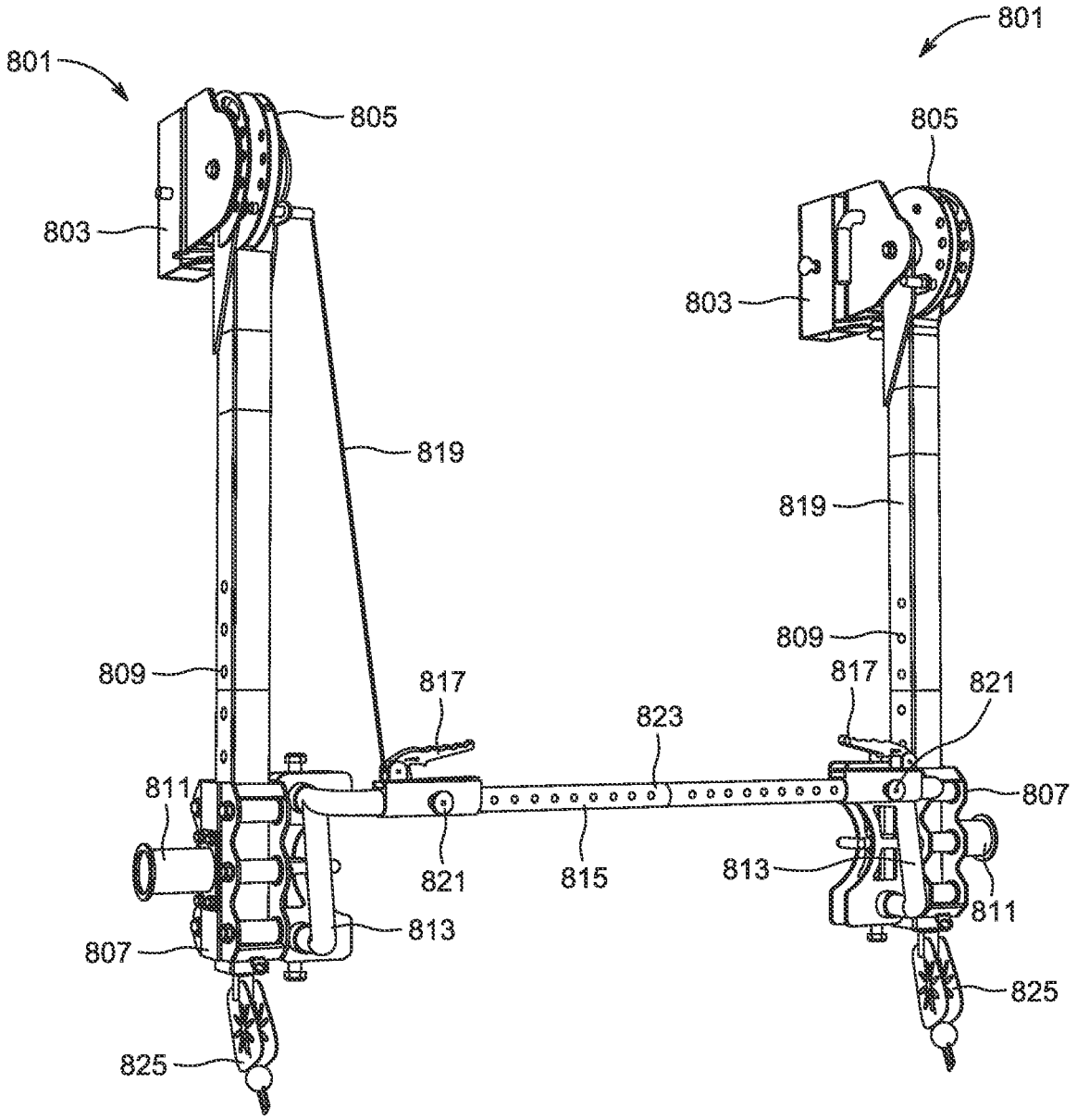
FIG. 8 is a front perspective view of an alternative pair of lever arms in accordance with one or more embodiments of the present invention.

In FIG. 8, a front perspective view of an alternative pair of lever arms 801 is depicted. The lever arms 801 include an attachment device 803 that couple the lever arms 801 to a vertical post (not shown). The attachment device 803 includes a rotating connection 805 for allowing the lever arms 801 to pivot up and down.

The lever arms 801 also include a trolley 807 removably secured thereto via a plurality of adjustment holes 809. The trolley 807 includes one or more attachment points 811 to receive and hold various devices that can be used for various exercises. In addition, the trolley 807 includes one or more handles 813 for user manipulation.

The lever arms 801 also include a horizontal bar 815 extending therebetween. The horizontal bar 815 includes a pair of handles 817 configured to move along the horizontal bar 815. In the preferred embodiment, a cable system 819 connects the attachment device 803 and the handles 817 for added resistance. The handles 817 may also include a locking pin 821 for removably securing the handles 817 to the horizontal bar 815 via a plurality of adjustment holes 823.

The lever arms 801 further include a cable attachment point 825 which allows for attachment of various cables that can be used for various exercises.

Figure 9:
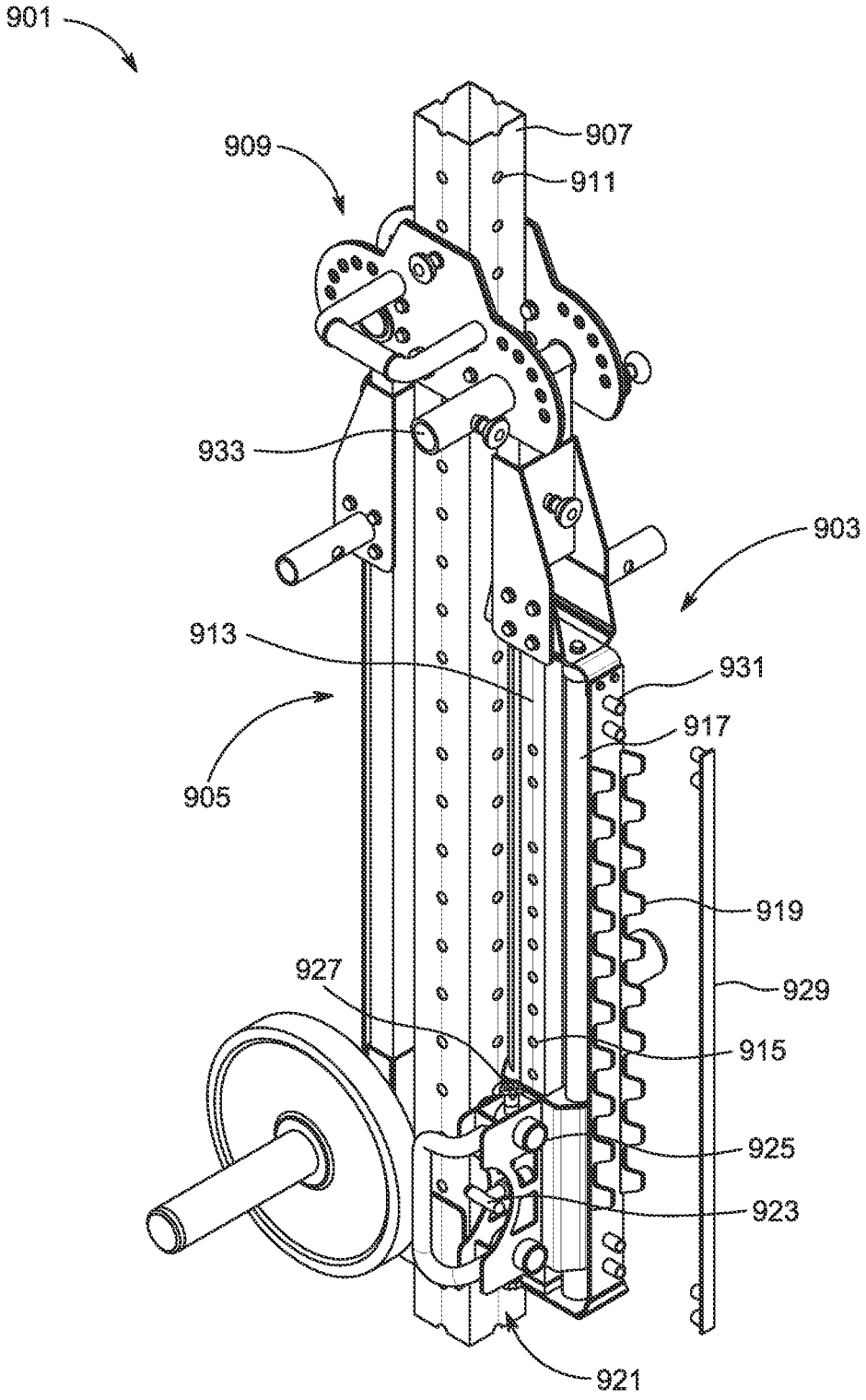
FIG. 9 is a front perspective view of an alternative exercise machine system in accordance with one or more embodiments of the present invention.

In FIG. 9, a front perspective view of an alternative exercise machine system 901 in accordance with the present application is depicted. It should be appreciated that the exercise machine system 901 may vary as functional, manufacturing, or aesthetical considerations require. In the preferred embodiment, the exercise machine system 901 includes a second system (not shown, see FIG. 9) that mimics the system discussed herein, thereby providing at least two arms for use.

In the contemplated embodiment, the exercise machine system 901 includes a lever arm 903 and a weight stack arm 905 coupled to a vertical post 907 via a main carriage 909. It should be appreciated that the vertical post 907 may be, at least in part, from a Smith machine, functional training rig, or the like, and may include a plurality of pin holes 911. In addition, it should be appreciated that the main carriage may adjust up and down the vertical post 907 via the plurality of pin holes 911.

The lever arm 903 includes a first column 913 having a plurality of pin holes 915, one or more rods 917 adjacent to the first column 913, a plurality of J-hooks 919, and a trolley 921. The trolley 921 is configured to slide up and down the first column 913 via one or more linear bearings (not shown) and the one or more rods 917. In the preferred embodiment, the one or more rods 917 are made of aluminum. The trolley 921 also includes one or more locking pins 923 to removably secure the trolley 921 to the first column 913 via the plurality of pin holes 915. It should be appreciated that the plurality of pin holes 915 allow the user to adjust the trolley 921 along the first column 913 to a desired height. In addition, the trolley 921 includes one or more attachment points 925 configured to receive and hold various devices that can be used for various exercises. Further, the trolley 921 includes one or more locking bolts 927 configured to removably secure various devices to the trolley 921.

The exercise machine system 901 also includes a cover bar 929 configured to cover the J-hooks 919 via one or more attachment points 931. In some embodiments, the cover bar 929 can be used as a stopper during leg press exercises.

It should be appreciated that during use, the user may disengage the lever arm 903 from the vertical post 907 and engage the lever arm 903 with the main carriage 909 via one or more locking pins 933.

Figure 10:
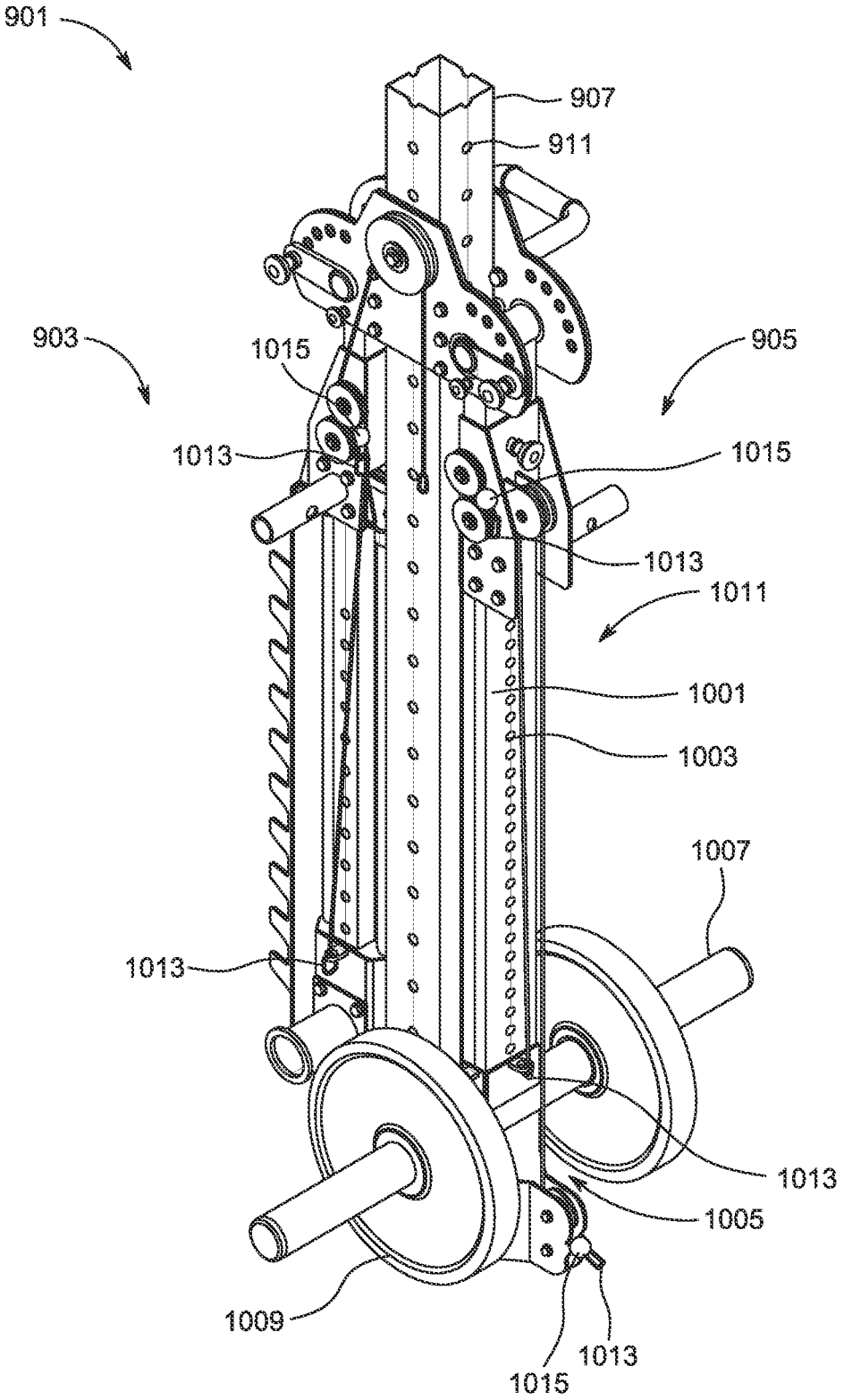
FIG. 10 is a rear perspective view of the exercise machine system of FIG. 9.

In FIG. 10, rear perspective view of the exercise machine system 901 is shown for clarity. As shown, weight stack arm 905 includes a second column 1001 having a plurality of pin holes 1003. The weight stack arm 905 also includes a weight carriage 1005, one or more barbells 1007 for the attachment of one or more weights 1009. The weight carriage 1005 is configured to move up and down the second column 1001 via a cable system 1011. It should be appreciated that the weight carriage 1005 serves as the main resistance arm for the exercise machine system 901.

The cable system 1011 includes a plurality of cable attachment points 1013 which allows for attachment of various cables that can be used for various exercises (e.g., high-end functional trainer, low-end functional trainer, pulleys, seated bench press, etc.). The cable system 1011 also includes one or more ball stops 1015 which govern cable retraction.

Figure 11:
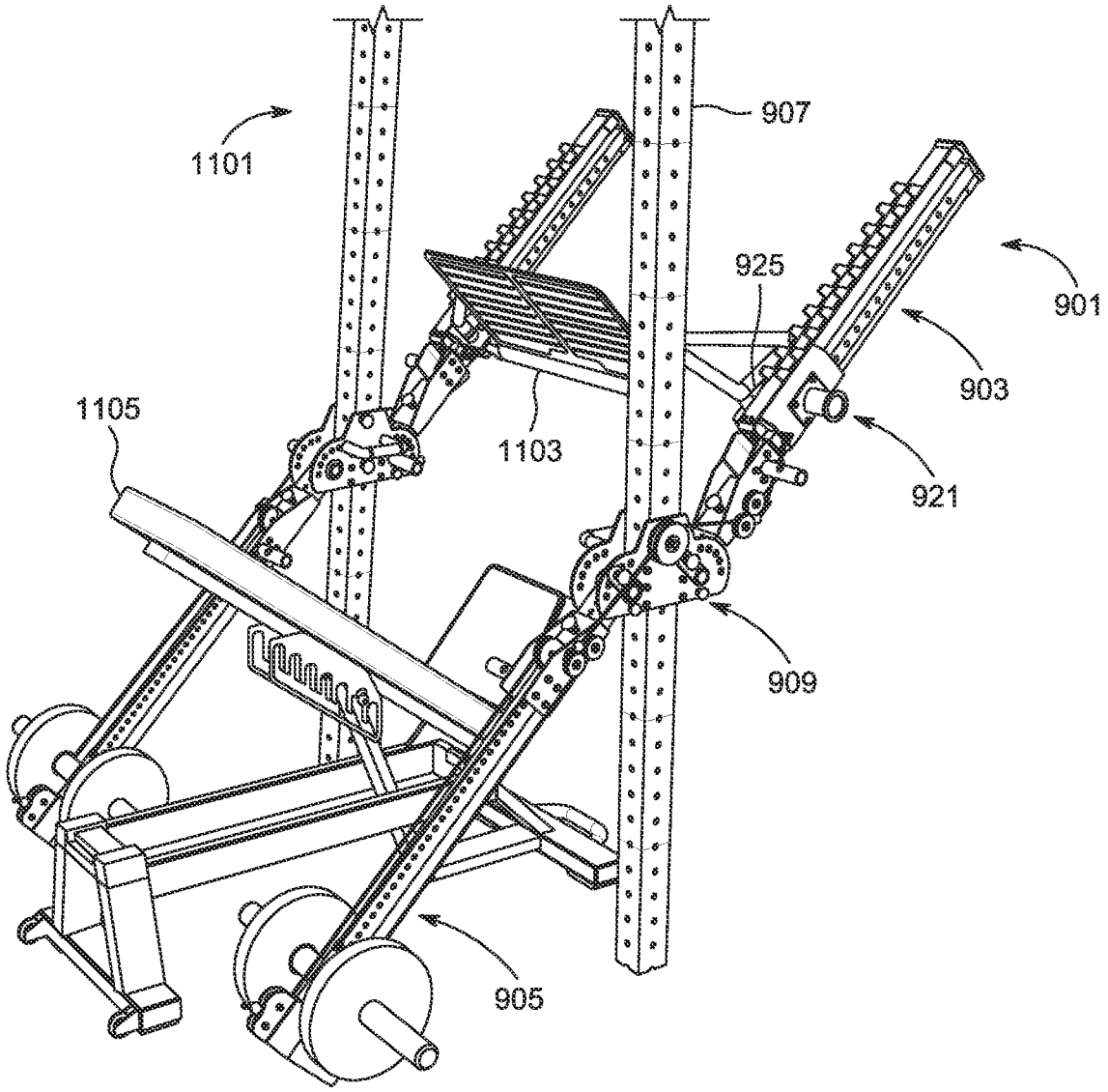
FIG. 11 is a perspective view of exercise machine system of FIG. 9 adapted for a leg press exercise.

In FIG. 11, a perspective view of the exercise machine system 901 adapted for a leg press exercise is depicted. As shown, system 901 and a second system that mimics system 901 engage with an exercise rig 1101. As shown, a leg press plate 1103 can couple to the trolley 921 via the one or more attachment points 925. It should be appreciated that the leg press plate 1103 is adjustable by angle in relation to system 901. In addition, a bench 1105 can be employed to enable the user to do various exercises with system 901.

Figure 12:
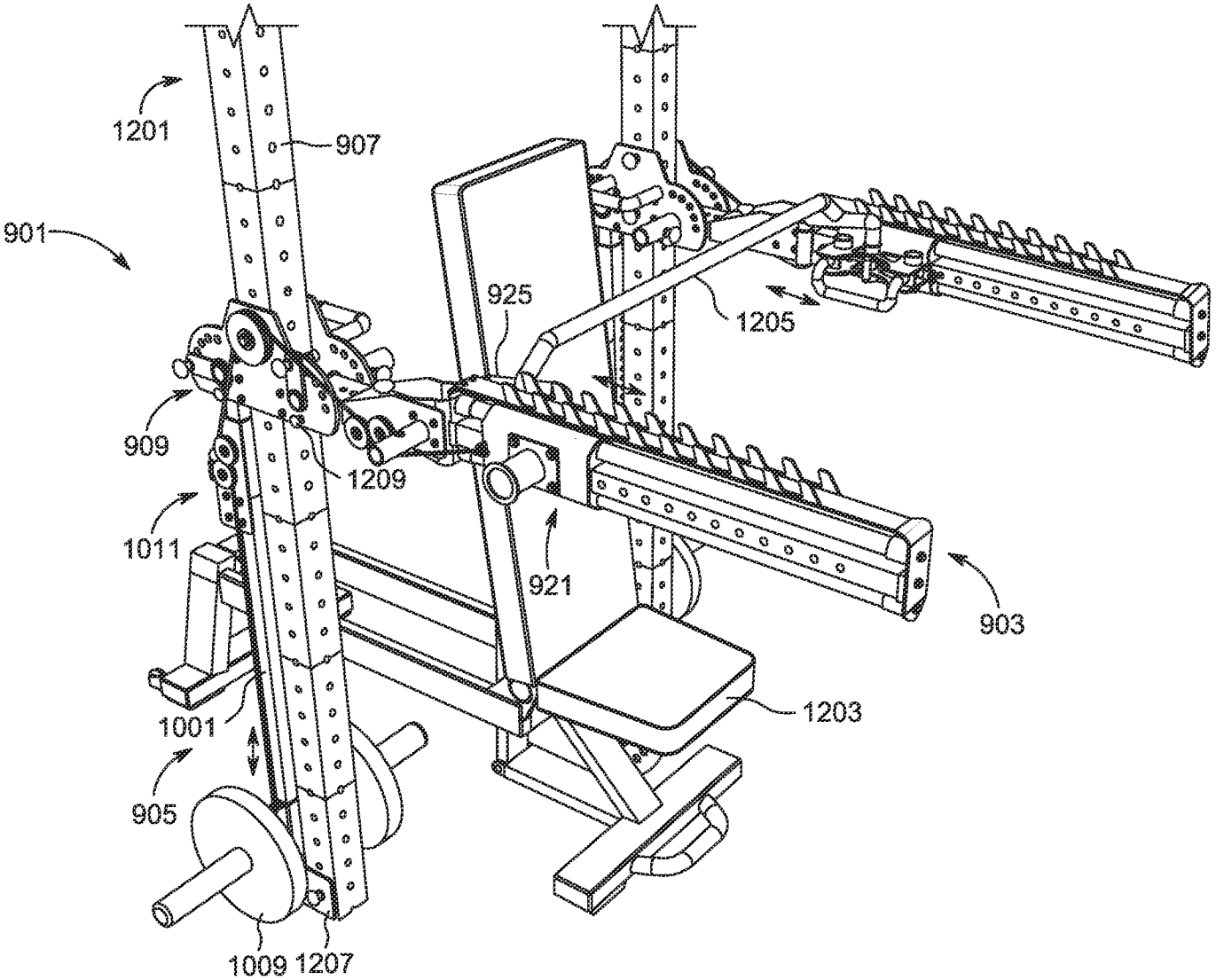
FIG. 12 is a perspective view of exercise machine system of FIG. 9 adapted for a seated bench press exercise.
Figure 13:
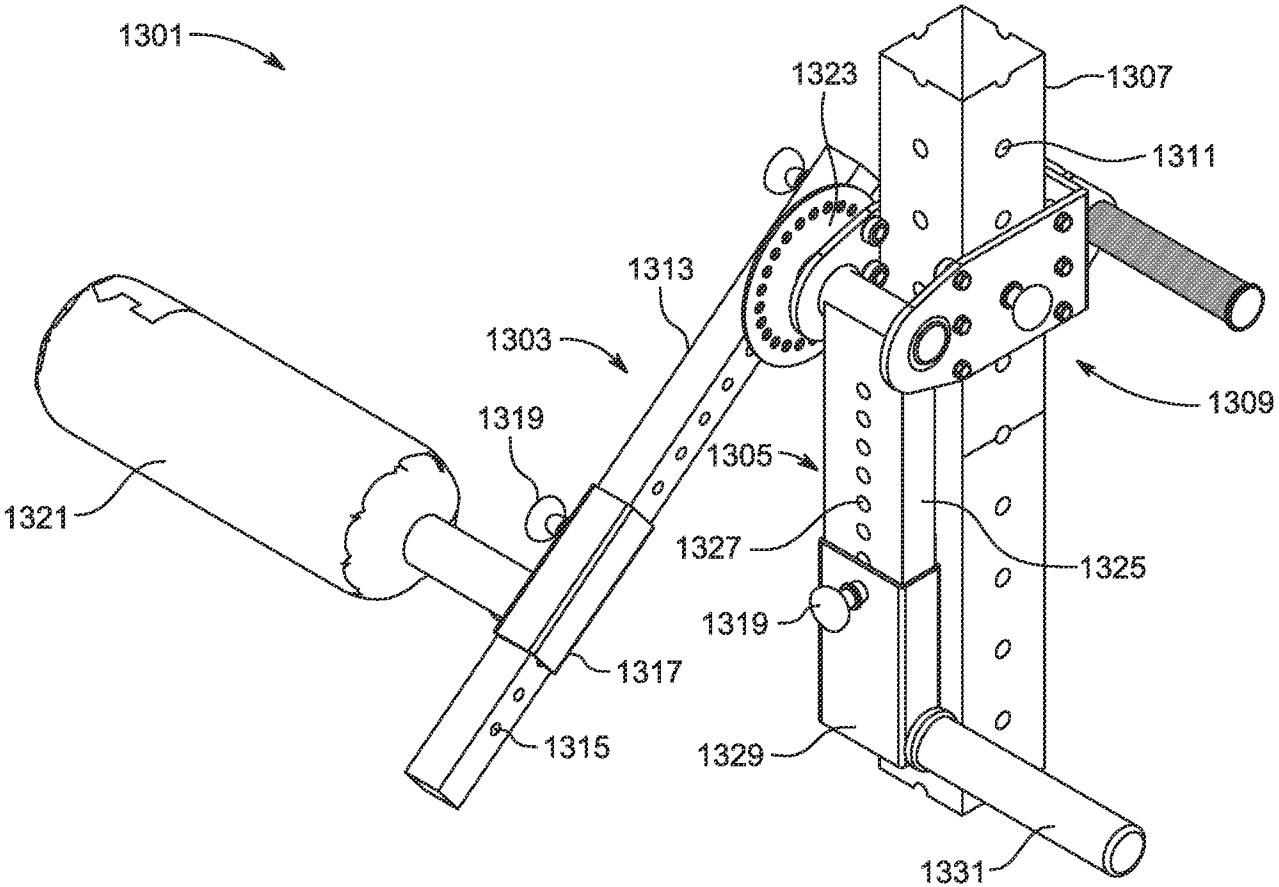
FIG. 13 is a front perspective view of another exercise machine system having a leg curl attachment in accordance with one or more embodiments the present invention.

In FIG. 12, a perspective view of the exercise machine system 901 adapted for a seated bench press exercise is depicted. As shown, system 901 and a second system that mimics system 901 engage with an exercise rig 1201. As shown, a bench 1203 is employed between system 901 and the second system. In addition, a horizontal bar 1205 couples to the trolley 921 via the one or more attachment points 925. Further, a latch 1207 securely locks the weight stack arm 905 in place with the vertical post 907 of the exercise rig 1201. The lever arm 903 is positioned at about a 90-degree from the vertical post 907 via one or more locking pins 1209 into the main carriage 909. During use, when a user sits on the bench 1203, the user grasps the horizontal bar 1205 and then pushes and pulls the horizontal bar 1205, as shown with directional arrows. As the horizontal bar 1205 is pushed forward, the trolley 921 travels along the lever arm 903 and the one or more weights 1009 move up the second column 1001 via the cable system 1011. As the horizontal bar 1205 is pulled toward the user, the trolley 921 travels along the lever arm 903 and the one or more weights 1009 move down the second column 1001 via the cable system 1011.

Referring now to FIGS. 13 through 23, various views of another exercise machine system 1301 is shown in accordance with one or more embodiments of the present invention. It should be appreciated that the exercise machine system 1301 may vary as functional, manufacturing, or aesthetical considerations require.

In the contemplated embodiment, the exercise machine system 1301 includes a lever arm 1303 and a weight stack arm 1305 coupled to a vertical post 1307 via a main carriage 1309. It should be appreciated that the vertical post 1307 may be, at least in part, from a Smith machine, functional training rig, or the like, and may include a plurality of pin holes 1311. In addition, it should be appreciated that the main carriage 1309 may adjust up and down the vertical post 1307 via the plurality of pin holes 1311.

The lever arm 1303 includes a first column 1313 having a plurality of pin holes 1315. The lever arm also includes a trolley 1317 removably secured thereto via one or more locking pins 1319. It should be appreciated that the plurality of pin holes 1315 allow the user to adjust the trolley 1317 along the first column 1313 to a desired height.

Figure 14:
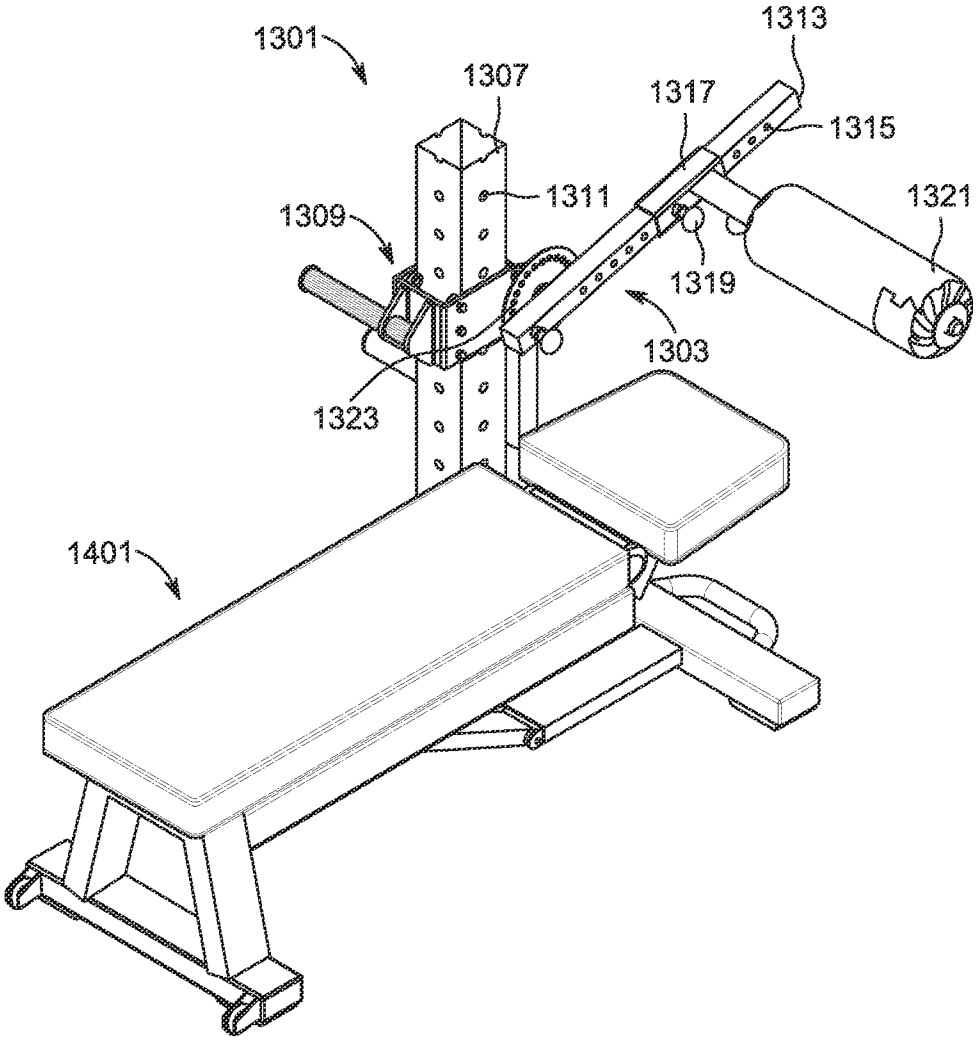
FIG. 14 is a rear perspective view of the exercise machine system of FIG. 13 adapted for a prone leg curl exercise.
Figure 15:
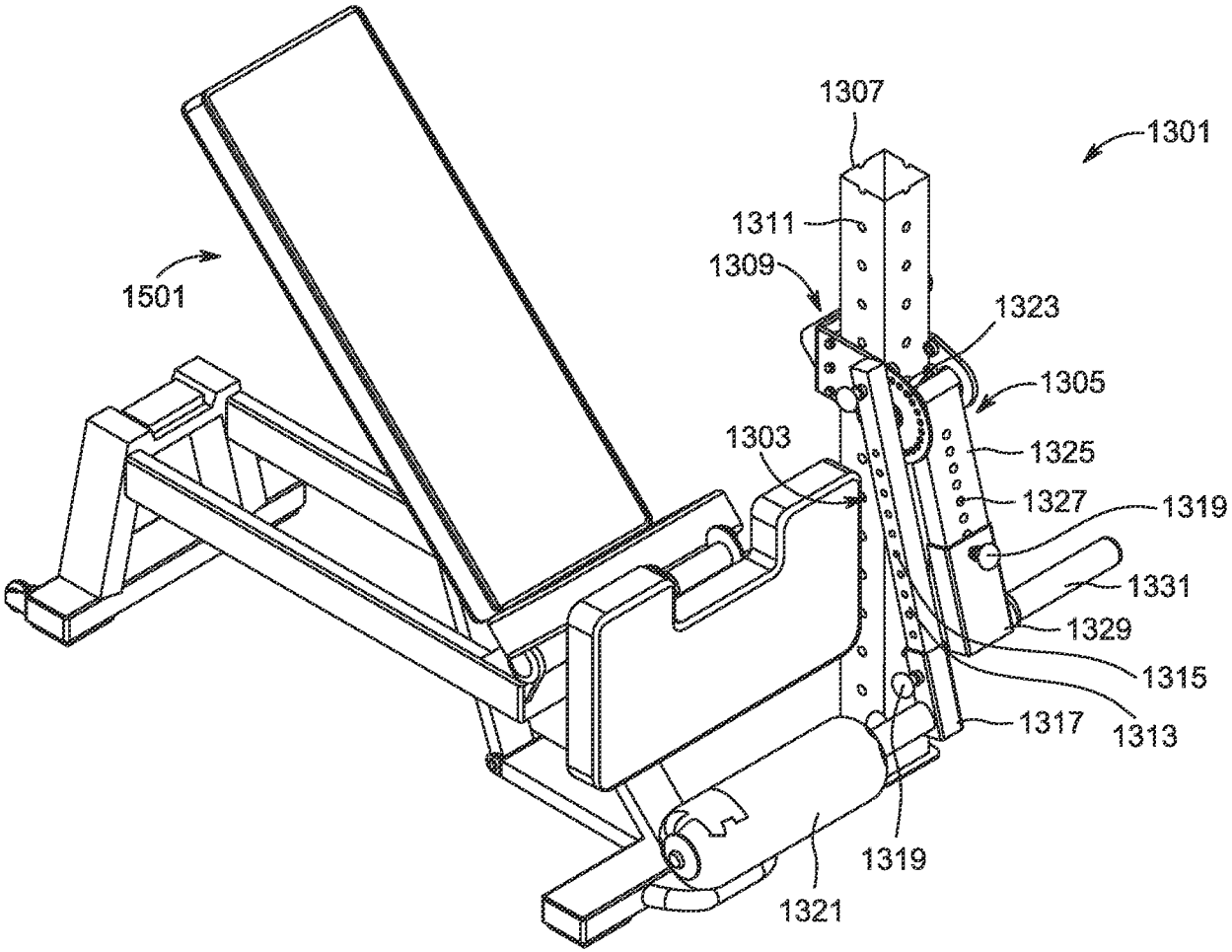
FIG. 15 is a front perspective view of the exercise machine system of FIG. 13 adapted for a seated leg extension exercise.
Figure 16:
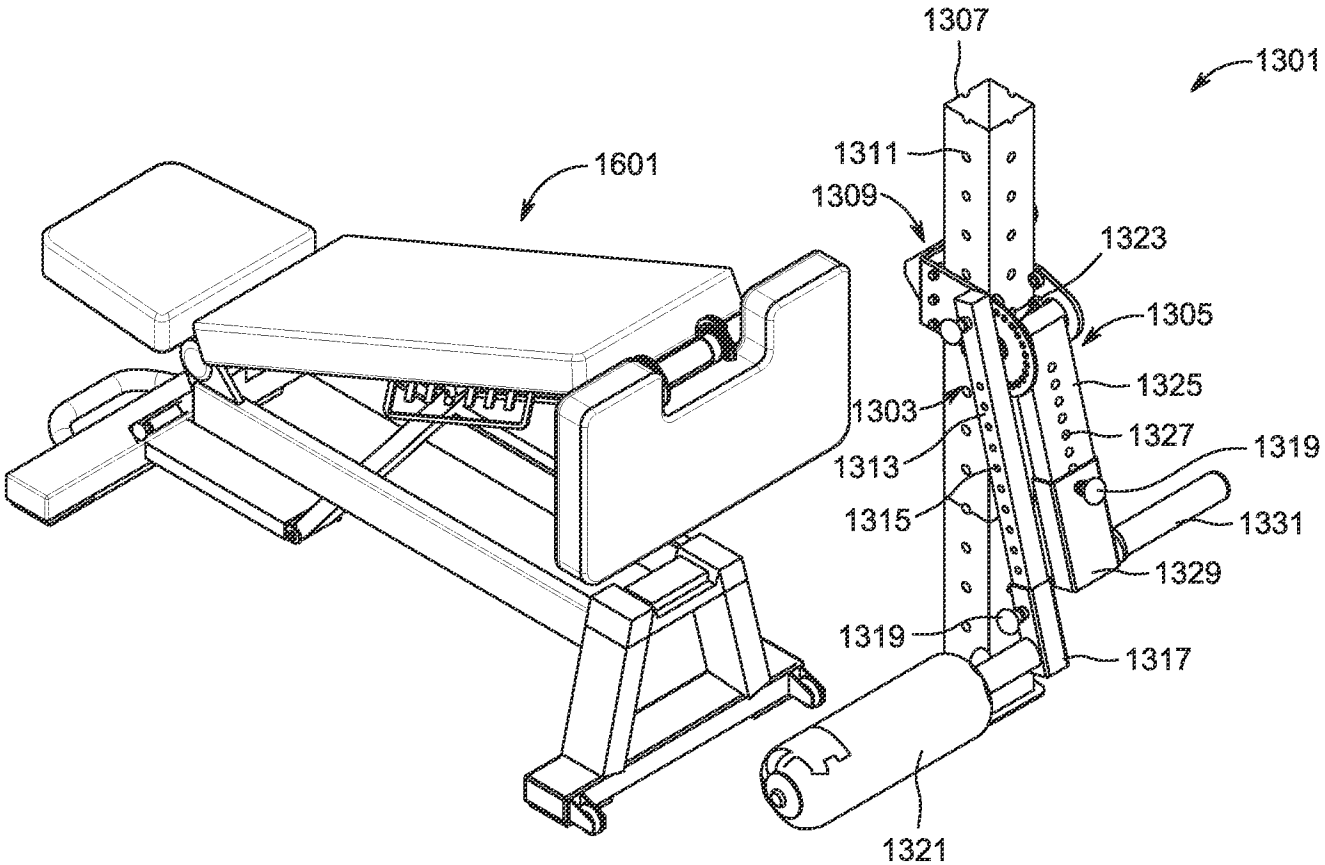
FIG. 16 is a front perspective view of the exercise machine system of FIG. 13 adapted for a standing leg curl exercise.

In some embodiments, the trolley 1317 is configured to receive and hold various attachments that can be used for various exercises. For example, as shown in FIGS. 13 through 16, a leg curl attachment 1321 is coupled to the trolley 1317. During use, the user user may place a bench (e.g., 1401, 1501, 1601) next to the exercise machine system 1301 to perform a prone leg exercise, a seated leg extension exercise, and a standing leg curl exercise using the leg curl attachment 1321, as shown in FIGS. 14 through 16, respectively.

Figure 17:
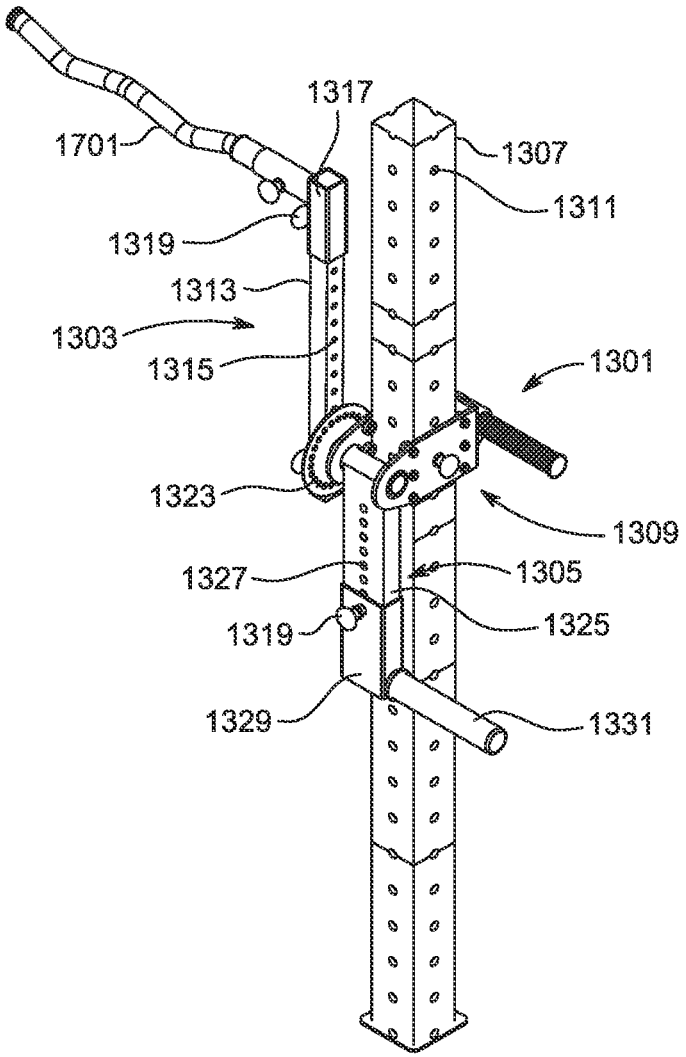
FIG. 17 is a front perspective view of the exercise machine system of FIG. 13 having a tricep bar attachment, illustrating the exercise machine system being adapted for a standing tricep extension exercise, in accordance with one or more embodiments of the present invention.

In another example, as shown in FIG. 17, a tricep bar attachment 1701 is coupled to the trolley 1317. During use, the user can perform a standing tricep extension exercise.

Figure 18:
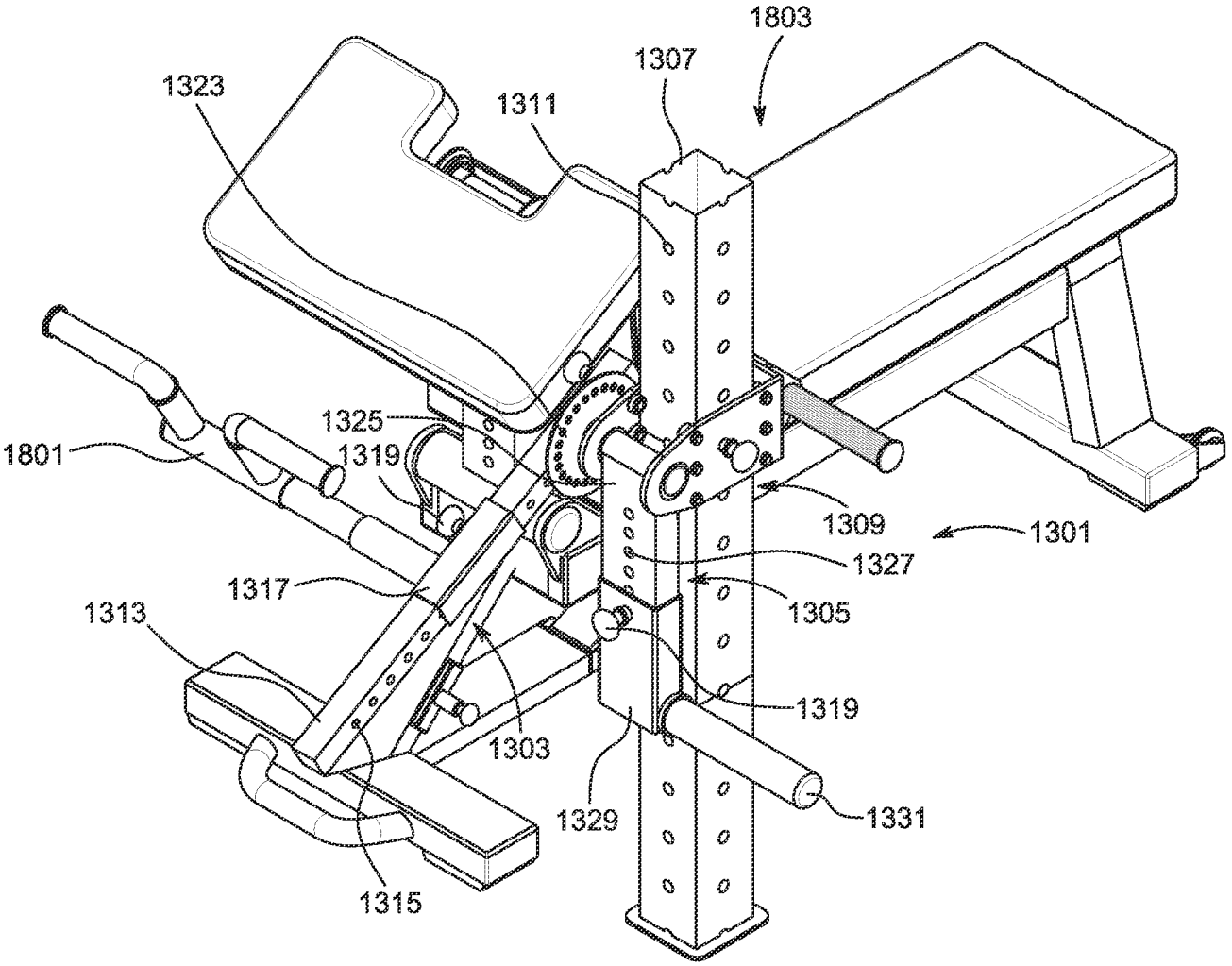
FIG. 18 is a front perspective view of the exercise machine system of FIG. 13 having an alternative tricep bar attachment, illustrating the exercise machine system being adapted for a seated preacher curl exercise.
Figure 19:
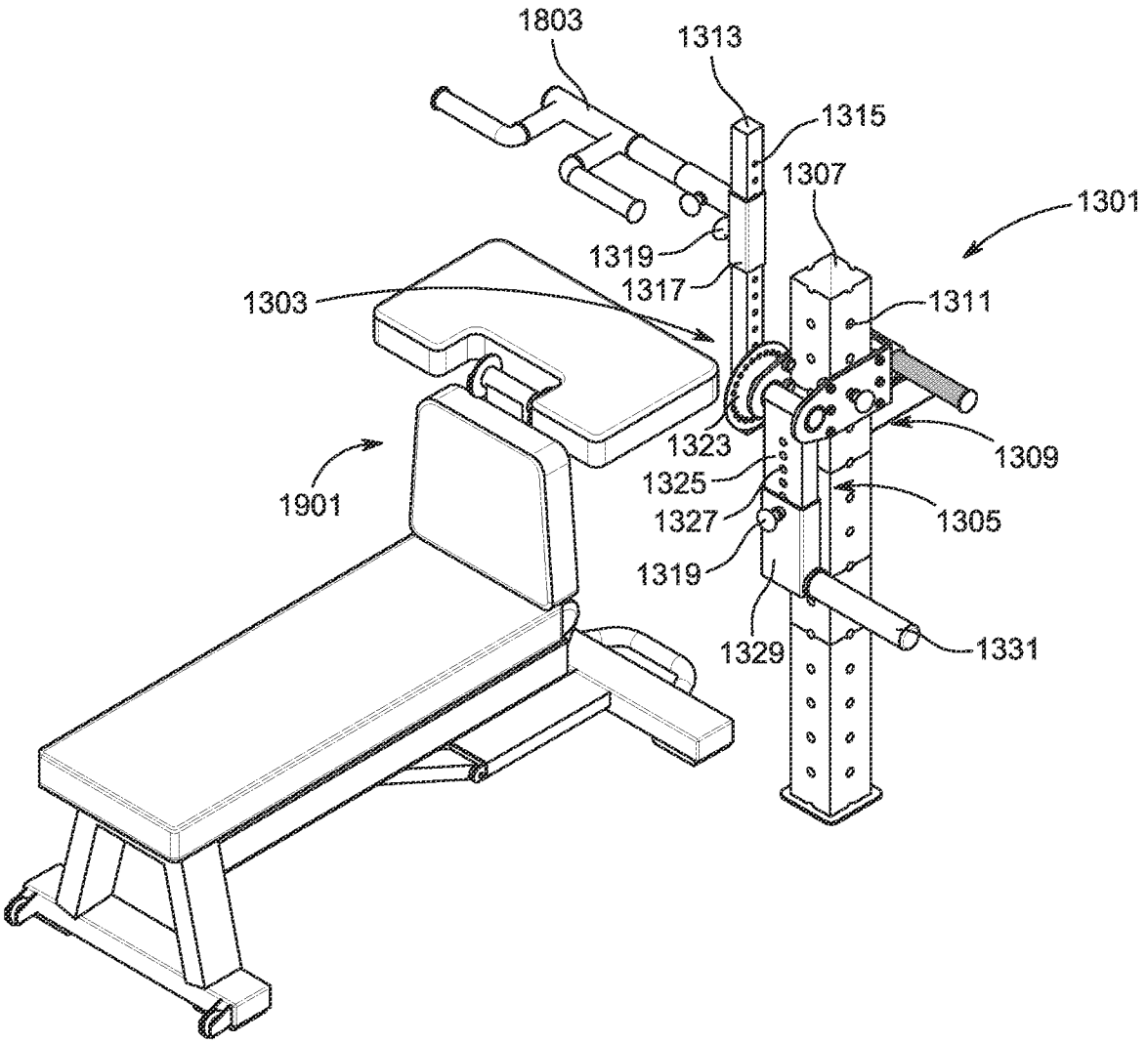
FIG. 19 is a front perspective view of the exercise machine system of FIG. 18 adapted for a seated tricep extension exercise.
Figure 20:
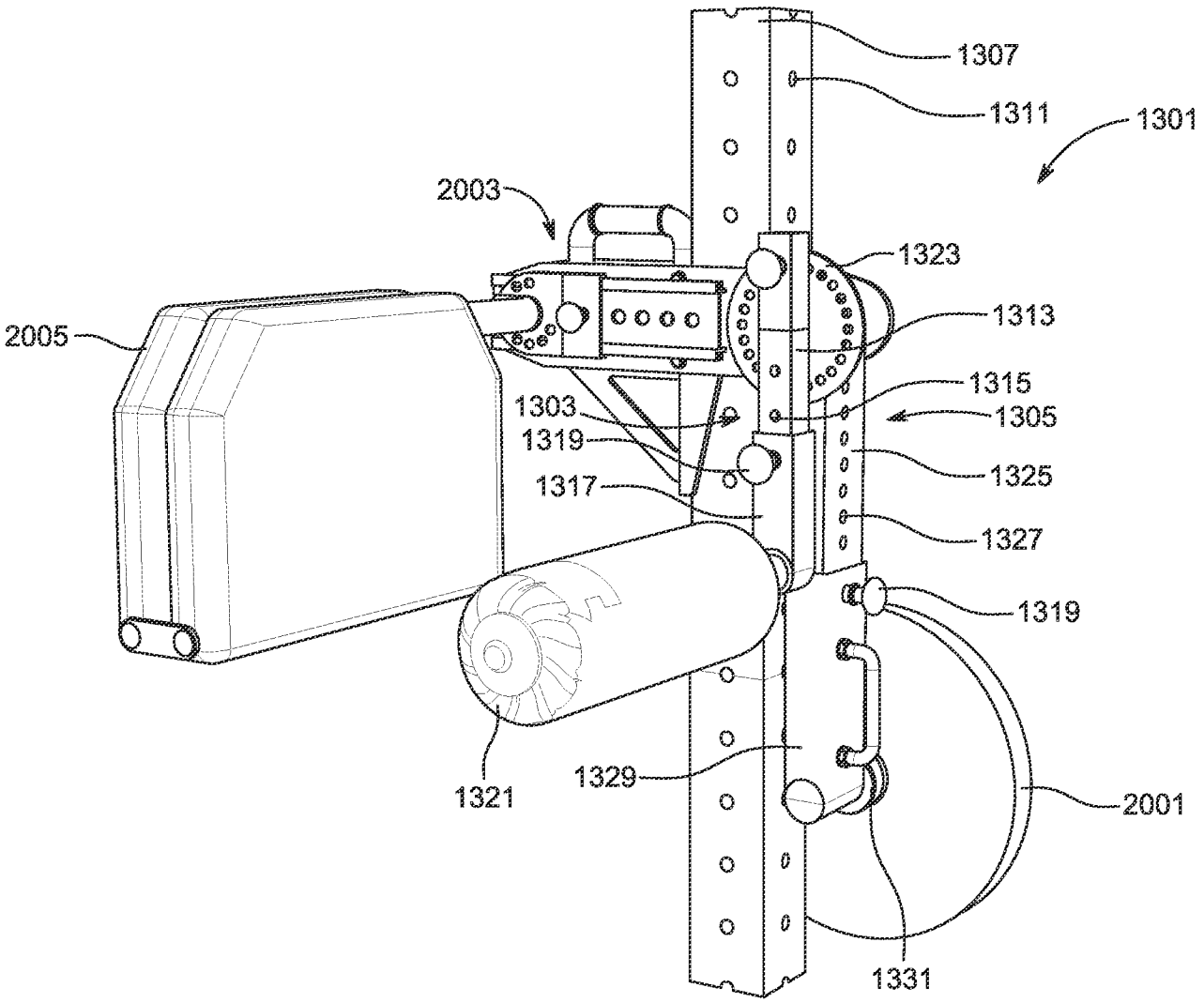
FIG. 20 is a side perspective view of the exercise machine system of FIG. 13, illustrating an alternative main carriage for coupling a bench seat thereto, the bench seat positioned for a closed leg extension exercise, in accordance with one or more embodiments of the present invention.
Figure 21:
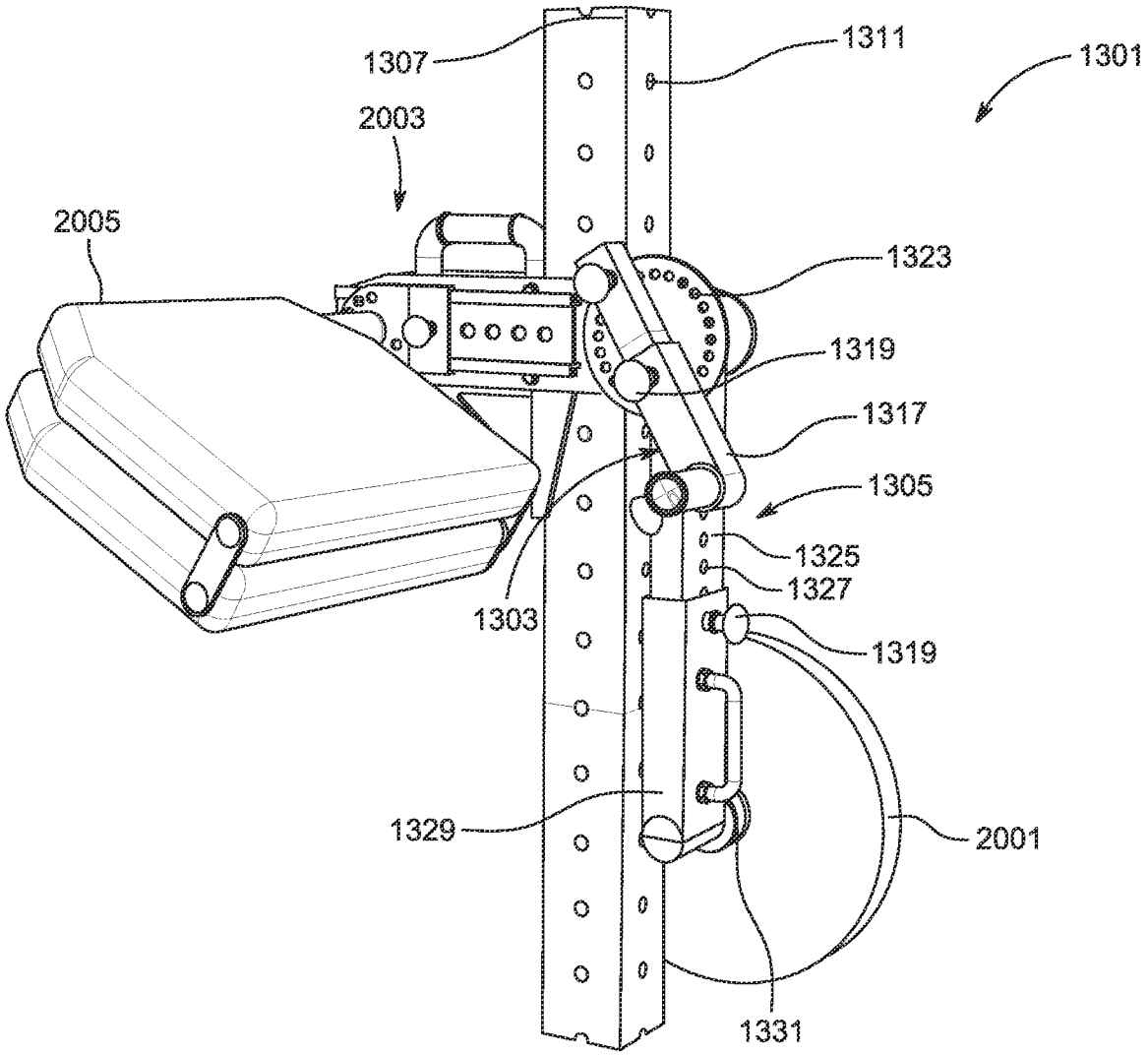
FIG. 21 is a side perspective view of the exercise machine system of FIG. 20, illustrating the bench seat positioned for a preacher curl exercise.
Figure 22:
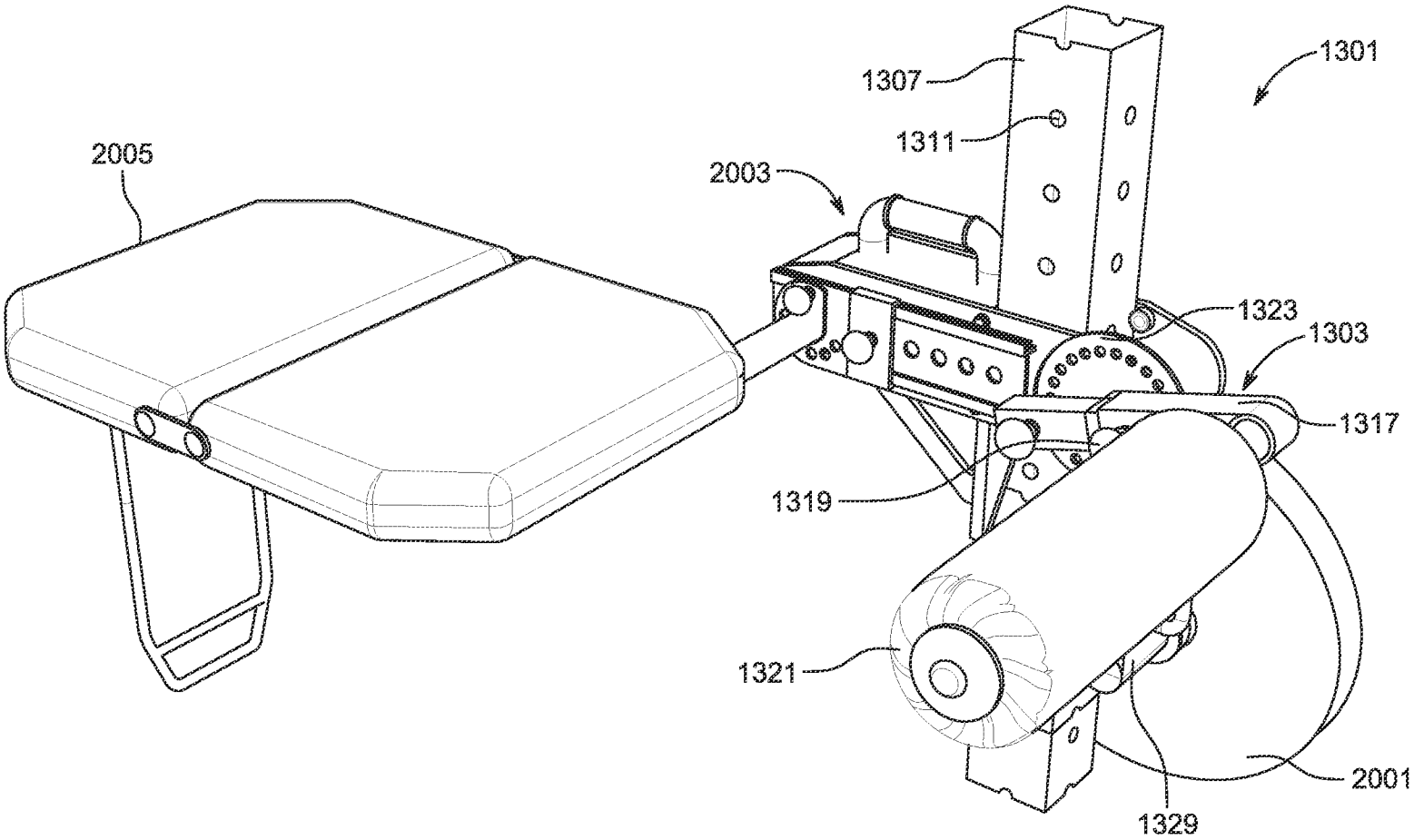
FIG. 22 is a side perspective view of the exercise machine system of FIG. 20, illustrating the bench seat positioned for a flat leg extension exercise.
Figure 23:
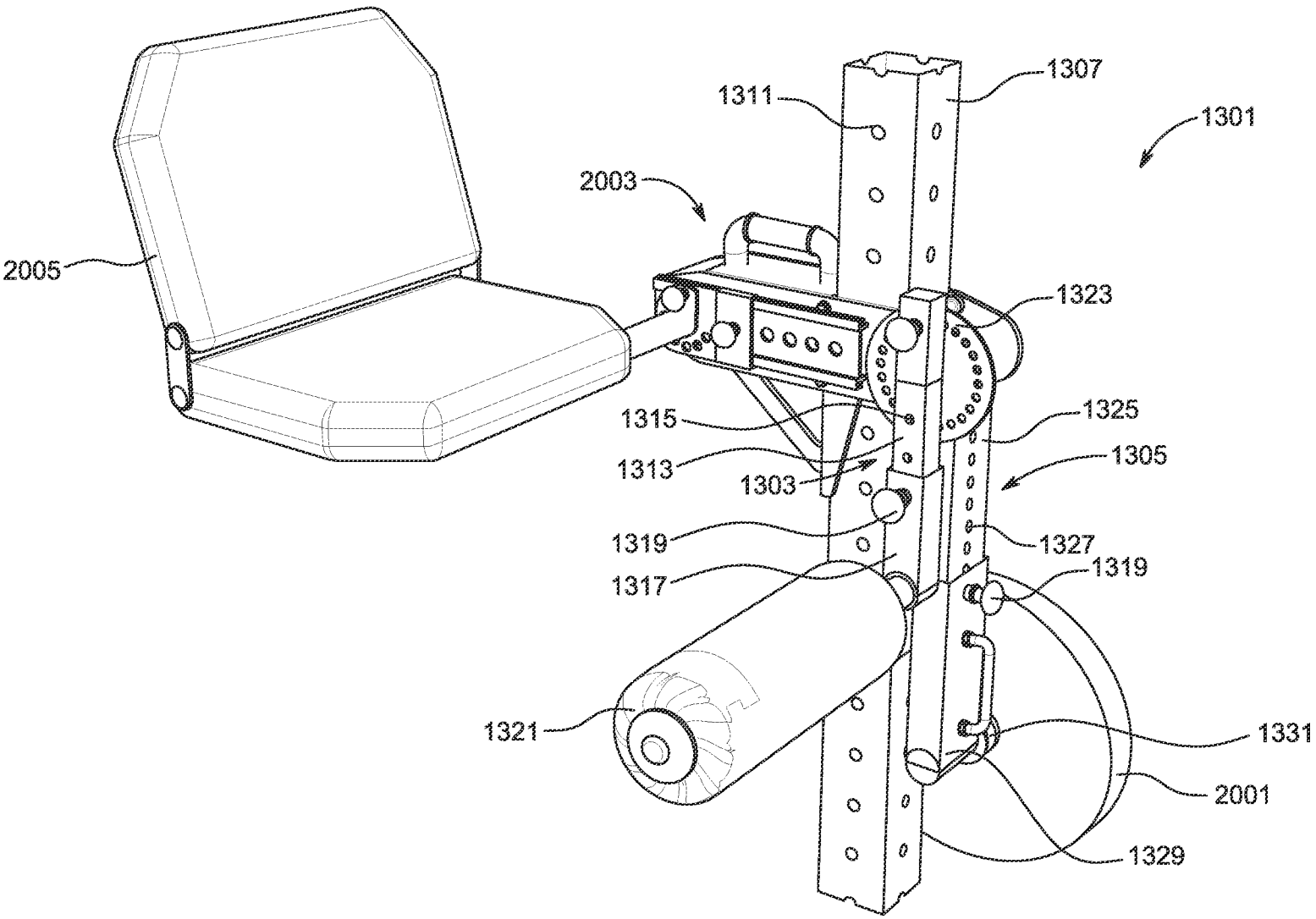
FIG. 23 is a side perspective view of the exercise machine system of FIG. 20, illustrating the bench seat positioned for a seated leg extension exercise.

In another example, as shown in FIGS. 18 and 19, an alternative tricep bar attachment 1801 is coupled to the trolley 1317. During use, the user may place a bench (e.g., 1803, 1901) next to the exercise machine system 1301 to perform a seated preacher curl exercise and a seated tricep extension exercise, respectively.

The lever arm 1303 further includes a rotating connection 1323 for allowing the lever arm 1303 to pivot up and down relative to the vertical post 1307.

The weight stack arm 1305 includes a second column 1325 having a plurality of pin holes 1327 for adjustability. The weight stack arm 1305 is configured to pivot up and down relative to the vertical post 1307. The weight stack arm 1305 also includes a weight carriage 1329 removably secured thereto via one or more locking pins 1319. It should be appreciated that the plurality of pin holes 1327 allow the user to adjust the weight carriage 1329 along the second column 1325 to a desired height. The weight carriage 1329 includes one or more barbells 1331 for the attachment of one or more weights 2001 (shown in FIGS. 20 through 23).

In alternative embodiments, the exercise machine system 1301 includes an alternative main carriage 2003 that couples the lever arm 1303 and the weight stack arm 1305 to the vertical post 1307, as shown in FIGS. 20 through 23. The main carriage 2003 is configured to receive and hold various devices such as a bench seat 2005 that can be used for various exercises. For example, during use, the user may perform a closed leg extension exercise (see FIG. 20), a preacher curl exercise (see FIG. 21), a flat leg extension exercise (see FIG. 22), and a seated leg extension exercise (see FIG. 23).

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. An exercise machine system comprising:

a first vertical post;

a first lever arm coupled to the first vertical post via a first carriage, the first lever arm configured to be operated by a user; and the first carriage forming a channel to receive the first vertical post therein, the first carriage having:

a pivoting system allowing for the first lever arm to: (1) rotate around a vertical axis to adjust between a first position around the vertical axis and a second position around the vertical axis; (2) rotate around a horizontal axis to adjust between a first position around the horizontal axis and a second position around the horizontal axis; and (3) pivot about a vertical plane, wherein the vertical plane is offset from and parallel to the vertical axis.

2. The exercise machine system of claim 1, further comprising:

a second vertical post; and a second lever arm coupled to the second vertical post via a second carriage, the second lever arm configured to be operated by the user.

3. The exercise machine system of claim 2, further comprising:

a first grip system engaged with the first lever arm, the first grip system having a first attachment device configured to engage with the first lever arm and a first tri-axis attachment extending inwardly from the first attachment device; and a second grip system engaged with the second lever arm, the second grip system having a second attachment device configured to engage with the second lever arm and a second tri-axis attachment extending inwardly from the second attachment device.

4. The exercise machine system of claim 3, wherein the first tri-axis attachment further comprises:

a horizontal bar extending from the first attachment device; and a handle coupled to the horizontal bar via a first connection and a second connection such that the handle is configured to move in at least two directions.

5. The exercise machine system of claim 2, further comprising:

a first grip system engaged with the first lever arm;

a second grip system engaged with the second lever arm;

a horizontal bar extending between the first grip system and the second grip system;

a first handle adjustably engaged with the horizontal bar;

a second handle adjustably engaged with the horizontal bar;

a first cable extending from the first handle to the first carriage; and a second cable extending from the second handle to the second carriage;

wherein the horizontal bar is configured to be manipulated by the user.

6. The exercise machine system of claim 1, further comprising a grip system coupled to the first lever arm, the grip system having an attachment device configured to receive the first lever arm therein, the attachment device supporting a handle and wherein the attachment device is configured to traverse along the first lever arm.

7. The exercise machine system of claim 6, further comprising a cable extending between the grip system and to a top end of the first lever arm.

8. The exercise machine system of claim 7, wherein the cable extends from a side of the attachment device upward to a cable guide extending horizontally outward from the first lever arm and further upward to a top cable support extending vertically upward from the first lever arm.

9. The exercise machine system of claim 1, wherein the pivoting system further comprises a side-to-side connection extending from a brace as part of the first carriage, the side-to-side connection configured to allow the first lever arm to rotate around the vertical axis.

10. The exercise machine system of claim 1, wherein the pivoting system further comprises a first plate extending from the carriage and a second plate extending from the lever arm, wherein the second plate rotates relative to the first plate to allow the lever arm to pivot about the vertical plane.

11. The exercise machine system of claim 1, wherein the first carriage is vertically adjustable along the first vertical post.

12. An exercise machine system comprising:

a vertical post;

a lever arm coupled to the vertical post via a carriage, the lever arm configured to be operated by a user;

the carriage forming a channel to receive the vertical post therein, the carriage having:

a first brace forming the channel;

a vertical hinge coupled to the first brace;

a second brace having a first side and a second side, the first side and second side each coupled to the vertical hinge; and a first side plate and a second side plate coupled to the second brace and supporting a horizontal hinge;

wherein a top end of the lever arm is positioned between the first side plate and the second side plate; and wherein the vertical hinge is configured to allow the lever arm to rotate around a vertical axis and the horizontal hinge is configured to allow the lever arm to rotate around a horizontal axis.

13. The system of claim 12, wherein the first lever arm has a starting position where the first lever arm is parallel with the first vertical post.

14. The system of claim 12, wherein the first carriage further comprises one or more pivot plates coupling the one or more side plates to the second brace.

15. The system of claim 12, wherein the carriage is configured such that the vertical hinge can lock into a desired position.

* * * * *